United States Patent [19]

Murray

[11] 4,446,943

[45] May 8, 1984

[54] FIRE SERVICE HARNESS

[76] Inventor: Richard C. Murray, 402 Lincoln Ave., Staten Island, N.Y. 10306

[21] Appl. No.: 471,682

[22] Filed: Mar. 3, 1983

[51] Int. Cl.[3] ..... A62B 1/16; A62B 35/00

[52] U.S. Cl. ..... 182/3; 182/6

[58] Field of Search ..... 182/3, 4, 5, 6, 7, 8, 182/9; 119/96, 101; 244/151 R

[56] References Cited

U.S. PATENT DOCUMENTS

| | | | |
|---|---|---|---|
| 481,923 | 9/1892 | Badger | 182/6 |
| 1,746,742 | 2/1930 | Roberts | 182/6 |
| 1,775,736 | 9/1930 | Rose | 182/6 |
| 2,252,998 | 8/1941 | Wachtel | 182/6 |
| 2,647,293 | 8/1953 | Wintercorn | 182/6 |
| 2,960,180 | 11/1960 | Wachtel | 182/3 |
| 4,308,629 | 1/1982 | Freemon | 182/3 |
| 4,378,921 | 4/1983 | Allen | 182/6 |
| 4,410,175 | 10/1983 | Shamp | 182/6 |

*Primary Examiner*—R. P. Machado

[57] ABSTRACT

A rappel harness for lowering a person from a building by rope having an oversized waist strap secured to the sides of the harness which support the person by means of a direct connection preferably to each leg strap and wherein the belly and leg straps are adjustable in girth so that the person can be safely, comfortably and without rearward toppling due to the center of gravity of the person being virtually in the same vertical plane as the supporting force of the lowering rope.

6 Claims, 5 Drawing Figures

FIRE SERVICE HARNESS

BACKGROUND OF THE INENTION

The instant invention relates generally to rappel harnesses and more specifically it relates to a new improved rappel harness that is designed to prevent toppling or swaying during use, such as a fireman descending a life saving rope to affect a rescue. The harness provides for the attachment of a rappel hook directly to a waist strap of the harness thereby eliminating the need for a handle, which may be the weakest point of present harnesses.

The rappel harness currently being used is attached to a rope and used in fire and rescue professions. It presently allows for the occurence of toppling or swaying of the rescuers body. Toppling is more prominant when a victim is to be picked up by the rescuer, causing additional weight to be placed on the rescuers body above the harness waist strap, unless the harness provides a chest or shoulder strap for added protection. Fire and rescue personnel prefer the low fitting waist harness.

SUMMARY OF THE INVENTION

A principle object of the present invention is to provide a new improved rappel harness that will prevent toppling or swaying.

Another object is to provide a new improved rappel harness that is stronger and safer than the present rappel harness.

An additional object is to provide a new improved rappel harness that has a rope attached to a rappel hook on the waist strap to eliminate sway torque.

A further object is to provide a new improved rappel harness that is simple and easy to use.

A still further object is to provide a new improved rappel harness that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
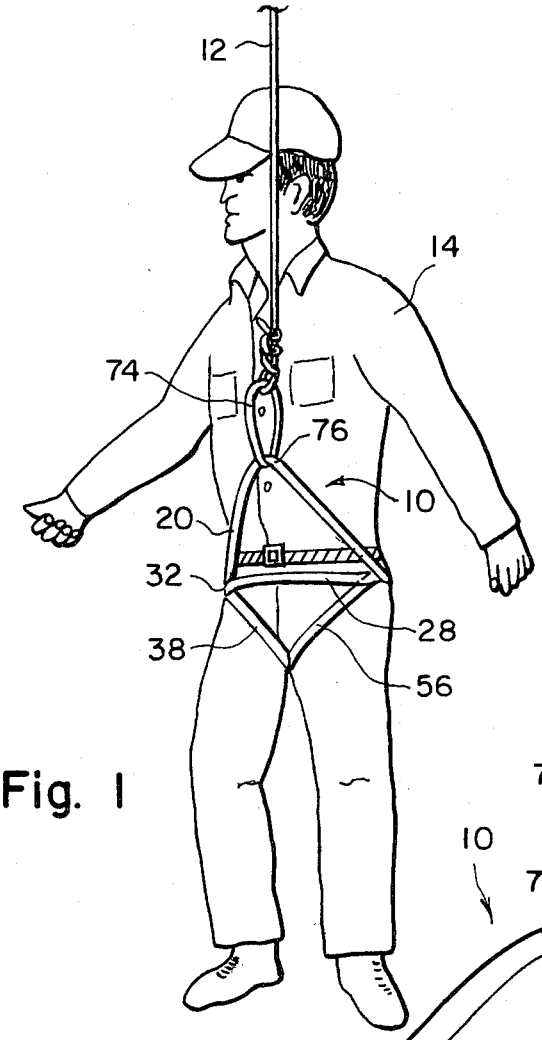
FIG. 1 is a front view of the invention in use.

Turning now descriptively to the drawings, in which similar reference characters denote similar elements throughout the several views, FIG. 1 illustrates a new improved rappel harness 10 that is removably attached to a rope 12 and keeps a rescuer 14 in a vertical position.

Figure 2:
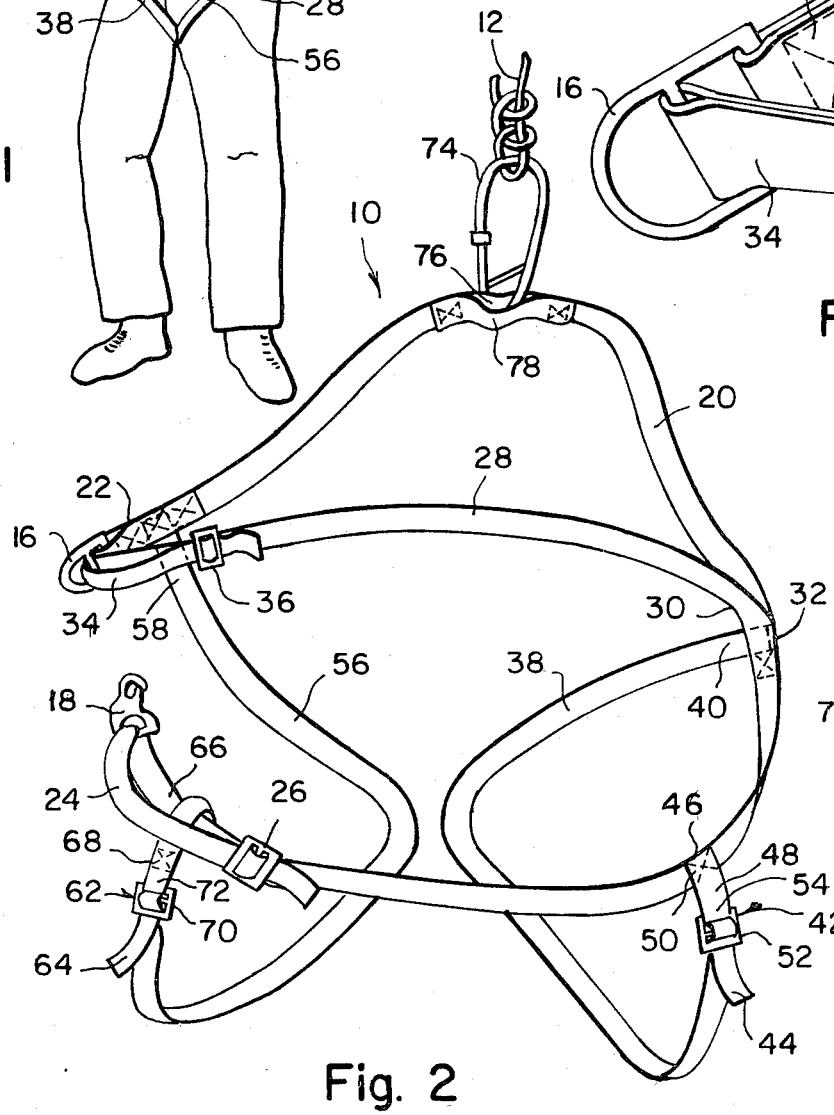
FIG. 2 is a rear perspective view.

As shown in greater detail in FIG. 2, the harness 10 consists of a ring buckle 16 and a snap hook 18 that is removably attached to the ring buckle 16. A waist strap 20 has a first end 22 affixed to the ring buckle 16 and a second end 24 extending around through the snap hook 18. A first buckle adjuster 26 is slideably placed onto the waist strap 20 near the snap hook 18 with the second end 24 of the waist strap 20 going through the first buckle adjuster 26 so that the waist strap 20 can be adjusted.

A belly strap 28 has a first end 30 affixed to right front side 32 of the waist strap 20 and a second end 34 extending around through the ring buckle 16. A second buckle adjuster 36 is slideably placed onto the belly strap 28 near the ring buckle 16 with the second end 34 of the belly strap 28 going through the second buckle adjuster 36 so that the belly strap 28 can be adjusted.

A right leg loop strap 38 has one end 40 affixed to the right front side 32 of the waist strap 20. A means 42 for adjusting free end 44 of the right leg loop strap 38 to right rear side 46 of the waist strap 28 is provided. The means 42 consists of a small strap 48 having one end 50 affixed to the right rear side 46 of the waist strap 20 and a buckle adjuster 52 affixed to other end 54 of the small strap 48. The free end 44 of the right leg loop strap 38 can go through the buckle adjuster 52 to be adjusted.

A left leg loop strap 56 has one end 58 affixed to left front side 60 of the waist strap 28 between the ring buckle 16 and the second buckle adjuster 36. A means 62 for adjusting free end 64 of the left leg loop strap 56 to left rear side 66 of the waist strap 20 is provided. The means 62 consists of a small strap 68 looped onto the waist strap 20 at 66 between the snap hook 18 and the first buckle adjuster 26. A buckle adjuster 70 is affixed to other end 72 of the small strap 68. The free end 64 of the left leg loop strap 56 can go through the buckle adjuster 70 to be adjusted.

A rappel hook 74 is placed onto front center 76 of the waist strap 20. A strip of webbing 78 is attached to the front center 76 of the waist strap 20 to retain the rappel hook 74 in a restricted area. The rappel hook 74 is removably attached to the rope 12 and keeps the rescuer 14 in a vertical position whereby sway torque is eliminated.

Figure 3A:
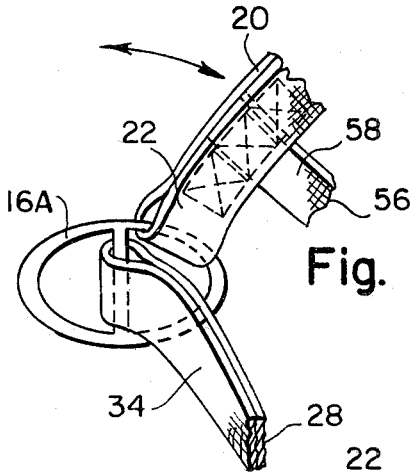
FIG. 3A is an enlarged perspective view of a modification of the "O" ring.
Figure 3:
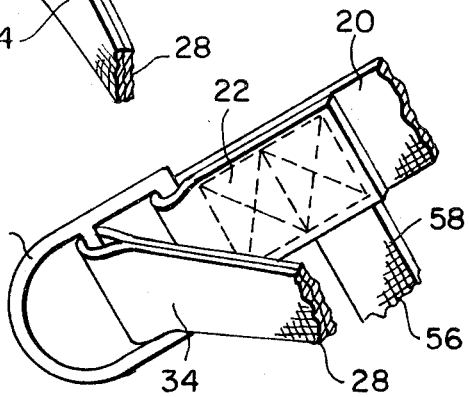
FIG. 3 is an enlarged perspective view of the "D" ring.

FIG. 3 shows the ring buckle 16 in greater detail. The ring buckle 16 is a "D"-shaped configuration. FIG. 3A shows another ring buckle 16A. This ring buckle 16A is an "O"-shaped configuration to allow for easy moving of the waist strap 20 when the harness 10 is lifted.

Figure 4:
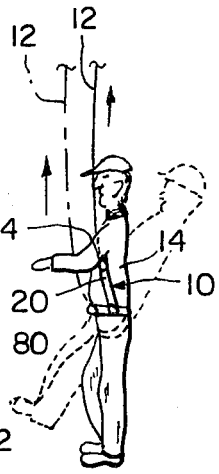
FIG. 4 is a side view comparing the hook up of the invention with the hook up of the prior art in phantom.

FIG. 4 shows a side view of the rescuer 14 in the harness 10 and the old hook up 80 that is done in the prior art. If the rescuer is hooked up at 80 toppling or swaying occurs. If the rescuer is hooked up at the rappel hook 74 toppling or swaying will not occur for the rope 12 is attached to the waist strap 20 via the rappel hook 74 eliminating sway torque.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A rappel harness for lowering a person from a building comprising:

(a) a belly strap with left and right sides, having opposing ends with means for securing said ends together to encircle the person's abdomen;

(b) a waist strap having left and right ends and an intermediate portion adapted to be mounted on a rappel hook for supporting the harness;

(c) a pair of left and right leg straps each having a loop for securing a person's leg, each said leg strap having an end secured respectively to the left and right ends of the waist strap and an opposite end secured to the belly strap at a point spaced from the left and right ends of the waist strap wherein said waist strap is longer than the shortest distance between its left and right ends whereby the waist strap will have slack when not loaded and will assume a position vertically above the belly strap when loaded and will be virtually in the same vertical plane as the connection points between the waist strap and each leg strap thereby preventing toppling of the person being lowered.

2. A harness as in claim 1 wherein the belly strap has means for adjusting its girth.

3. A harness as in claim 1 wherein the leg straps have means for adjustment.

4. A harness as in claim 2 wherein the belly strap ends have a coacting hook and ring for interconnection, wherein said hook and ring are mounted on the said side of the belly strap that includes the means for adjusting the girth.

5. A harness as in claim 1 wherein one of said ends of said waist strap extends beyond the point of connection with one of said leg straps and includes means for connection to one of said ends of the belly strap, and wherein said other end of said waist strap is also connected to the belly strap.

6. The harness of claim 1 wherein said waist strap intermediate portion includes means for retaining the rappel hook in a central position.

* * * * *